United States Patent [19]

Scarselletta

[11] Patent Number: 4,768,484

[45] Date of Patent: Sep. 6, 1988

[54] ACTIVELY PRESSURIZED ENGINE COOLING SYSTEM

[75] Inventor: Louis Scarselletta, Lockport, N.Y.

[73] Assignee: General Motors Corporation, Detroit, Mich.

[21] Appl. No.: 72,982

[22] Filed: Jul. 13, 1987

[51] Int. Cl.[4] ..... F01P 3/22

[52] U.S. Cl. ..... 123/41.21; 123/41.44

[58] Field of Search ..... 123/41.2–41.27, 123/41.44

[56] References Cited

U.S. PATENT DOCUMENTS

| | | | |
|---|---|---|---|
| 4,109,617 | 8/1978 | Ernest | 123/41.74 |
| 4,367,699 | 1/1983 | Evans | 123/41.21 X |
| 4,381,736 | 5/1983 | Hirayama | 123/41.1 |
| 4,510,893 | 4/1985 | Schweiger et al. | 123/41.02 |
| 4,531,900 | 7/1985 | Jones et al. | 418/83 X |
| 4,539,942 | 9/1985 | Kobayashi et al. | 123/41.1 |
| 4,539,943 | 9/1985 | Tsuchikawa et al. | 123/41.05 |
| 4,545,335 | 10/1985 | Hayashi | 123/41.27 |
| 4,549,505 | 10/1985 | Hirano | 123/41.08 |
| 4,557,223 | 12/1985 | Ngueyen | 123/41.44 X |
| 4,664,607 | 5/1987 | Jones | 418/83 X |

OTHER PUBLICATIONS

Procedures on the Institution of Mechanical Engineers, Factors Influencing Combustion Chamber Wall Temperatures in the Liquid-Cooled, Automotive Spark-Ignition Engine, vol. 199, No. D3, p. 207, 1985-Feb.

*Primary Examiner*—Tony M. Argenbright
*Attorney, Agent, or Firm*—R. L. Phillips

[57] ABSTRACT

Method and apparatus are disclosed for an engine cooling system with the coolant fluid maintained in a state of nucleate boiling at a selected location in the coolant passages of the engine. The cooling system comprises a radiator and a coolant reservoir with a variable speed circulating pump for circulating the coolant through the coolant passages in the engine and through the radiator. A coolant pressure pump with a servo motor is adapted to pump coolant between the radiator and the reservoir as needed and to adjust the static pressure of the coolant. The coolant flow through the radiator is adjusted to maintain the coolant at a selected location at a control temperature which will maintain a safe metal operating temperature for the engine. The static pressure of the coolant is adjusted to a value at which the saturation temperature of the coolant is near the control temperature so that nucleate boiling will occur at the selected location. The cooling system is controlled by an electronic control module including a microcomputer; temperature and pressure signals from sensors in the engine are supplied to the microcomputer which, under program control, controls the variable speed of the circulating pump and the operation of the pressure pump to maintain the nucleate boiling condition.

8 Claims, 7 Drawing Sheets

ACTIVELY PRESSURIZED ENGINE COOLING SYSTEM

FIELD OF THE INVENTION

This invention relates to engine cooling systems; more particularly, it relates to a cooling system of the type using a circulating liquid coolant and which is especially adapted for automotive vehicles.

BACKGROUND OF THE INVENTION

It is well known that the efficiency and the exhaust emissions of an internal combustion engine are dependent upon the operating temperature of the engine. In general, and within limits at higher operating temperatures the efficiency is increased and the volume of emissions is decreased. However, it is known that excessive metal temperatures can reverse the trend and greatly reduce the durability of the engine. Accordingly, it is desired to operate the engine at a high temperature consistent with safe metal temperature in steady state or prolonged running conditions. However, brief excursions to a higher maximum temperature due to transient loading or other operating conditions are permissible without unduly affecting engine durability. It is further desired to bring the engine to its optimum operating temperature immediately after start-up and to prevent overheating after engine shut down. For this purpose, it is desired to provide an engine cooling system utilizing a circulating liquid coolant with a coolant control system which adapts the rate of system heat transfer capacity to the engine heat rejection under various operating conditions so that an optimum operating temperature is maintained without blanket boiling during engine running and without after-boil after engine shut down. Blanket boiling occurs when the boiling point of the coolant is exceeded by the metal temperature and the heat flux is such that vapor is produced at such a rate that a film or blanket is formed over the metal surface. This has the undesirable effect of greatly increasing the resistance to heat transfer with a resulting danger of overheating the engeine. After-boil can also produce a damaging condition; it occurs after engine shut-down due to heat storage or a sudden reduction in local pressure in the engine which causes vigorous boiling of the coolant. This blows the coolant out of the coolant passages in the engine head and restarting the engine without coolant in the head may damage the engine head. In order to meet present day requirements, especially in passenger cars, such a cooling system must provide the afore-mentioned performance characteristics with a small number of low cost components of reduced weight and size and with a minimum of wasted power.

The conventional engine cooling system, as used in present day passenger cars, utilizes a circulating liquid coolant in primarily a convection heat transfer mode between the engine and a heat exchanger or radiator. The most common liquid coolant is a mixture of water and ethylene glycol. Typically the fluid is circulated by a circulating pump driven by the engine which runs proportional to engine speed. The heat transfer capacity of the radiator to the surrounding atmosphere is enhanced by ram air or by a fan which may be driven by the engine or by an electric motor which is controlled in accordance with radiator temperature. In order to provide a fast engine warm-up and for providing a degree of temperature regulation during other operating conditions, a thermostat is provided in a radiator inlet passage which is closed until a predetermined temperature is reached.

The influence on cylinder head temperatures of parameters such as cylinder head material, coolant composition, pressure, temperature and velocity has been investigated and reported by Finlay et al in *Factors Influencing Combustion Chamber Wall Temperatures In The Liquid-Cooled, Automotive, Spark-Ignition Engine,* Procedures on the Institution of Mechanical Engineers, Volume 199, No. D3, page 207, 1985. According to this report, each of the parameters was systemmatically varied and its influence on combustion wall chambers was measured. The results, according to the authors, suggest that nucleate boiling can play an important role in the transfer of heat from cylinder head to the coolant.

In the prior art cooling systems are known which utilize a variable speed electric motor for driving the circulating pump. This is described in the Gueyen U.S. Pat. No. 4,557,223 granted Dec. 10, 1985. In the system of this patent, the motor speed is controlled as a function of the coolant temperature and as a function of engine intake air pressure. Also, a variable speed radiator fan driven by an electric motor is operated at a speed which is a function of the coolant temperature.

Also, it is known in the prior art to provide a cooling system for an internal combustion engine wherein a liquid coolant is boiled by the heat rejected by the engine and the vapor is used as a vehicle for removing heat from the engine. Such a cooling system is disclosed in the Hayashi U.S. Pat. No. 4,545,335 granted Oct. 8, 1985 and by the Hirano U.S. Pat. No. 4,549,505 granted Oct. 29, 1985.

A general object of this invention is to provide an improved cooling system for internal combustion engines, and especially adapted for automotive vehicles, which overcomes certain disadvantages of the prior art.

SUMMARY OF THE INVENTION

In accordance with this invention, the engine cooling system capacity is adapted to maintain optimum engine operating temperature under varying operating conditions and to minimize wasted energy. This is accomplished by a circulating liquid coolant under controlled static pressure such that the saturation temperature is maintained just above the coolant bulk temperature so that nucleate boiling will occur at a selected high heat fulx region of the engine. The coolant flow rate is adjusted so that the coolant heat capacity is sufficient, while being maintained in nucleate boiling at the bulk temperature, to absorb the engine heat rejection without blanket boiling. The cooling system is adaptable to a wide range of vehicle types and nonautomotive applications from high performance sprint race car applications to passenger car applications. The system is modular in the sense that it may be used to meet particular system requirements by adding of deleting components such as a passenger compartment heater.

Further, in accordance with this invention, an engine cooling system is operated to maintain the coolant at a control temperature selected location in the engine coolant passages which results in a desired metal operating temperature. The bulk coolant temperature at that location is measured and the static pressure of the coolant is controlled at a value at which the saturation temperature of the coolant is near the control temperature so that nucleate boiling will occur at the metal interface.

The cooling capacity of the heat exchanger of the system is adjusted to prevent blanket boiling of the coolant.

Further, in accordance with this invention, an engine cooling system, especially adapted for automotive vehicles is provided with a radiator, a circulating pump for circulating a liquid coolant through coolant passages in the engine and through the radiator. Means are provided for pressurizing the system so that the saturation temperature of the coolant is near a control temperature such that nucleate boiling will occur at a selected location in the cooling passages. Means are provided for controlling the circulation rate and have heat capacity rate of the coolant to prevent blanket boiling of the coolant.

Further, in accordance with this invention, a cooling system is provided which, in addition to pressurization control for operation in the nucleate regime, provides for engine shut down protection. Further, it optionally provides for a passenger compartment heater control and for low coolant protection.

A complete understanding of this invention may be obtained from the detailed description that follows taken with the accompanying drawings.

BEST MODE FOR CARRYING OUT THE INVENTION

Figure 1:
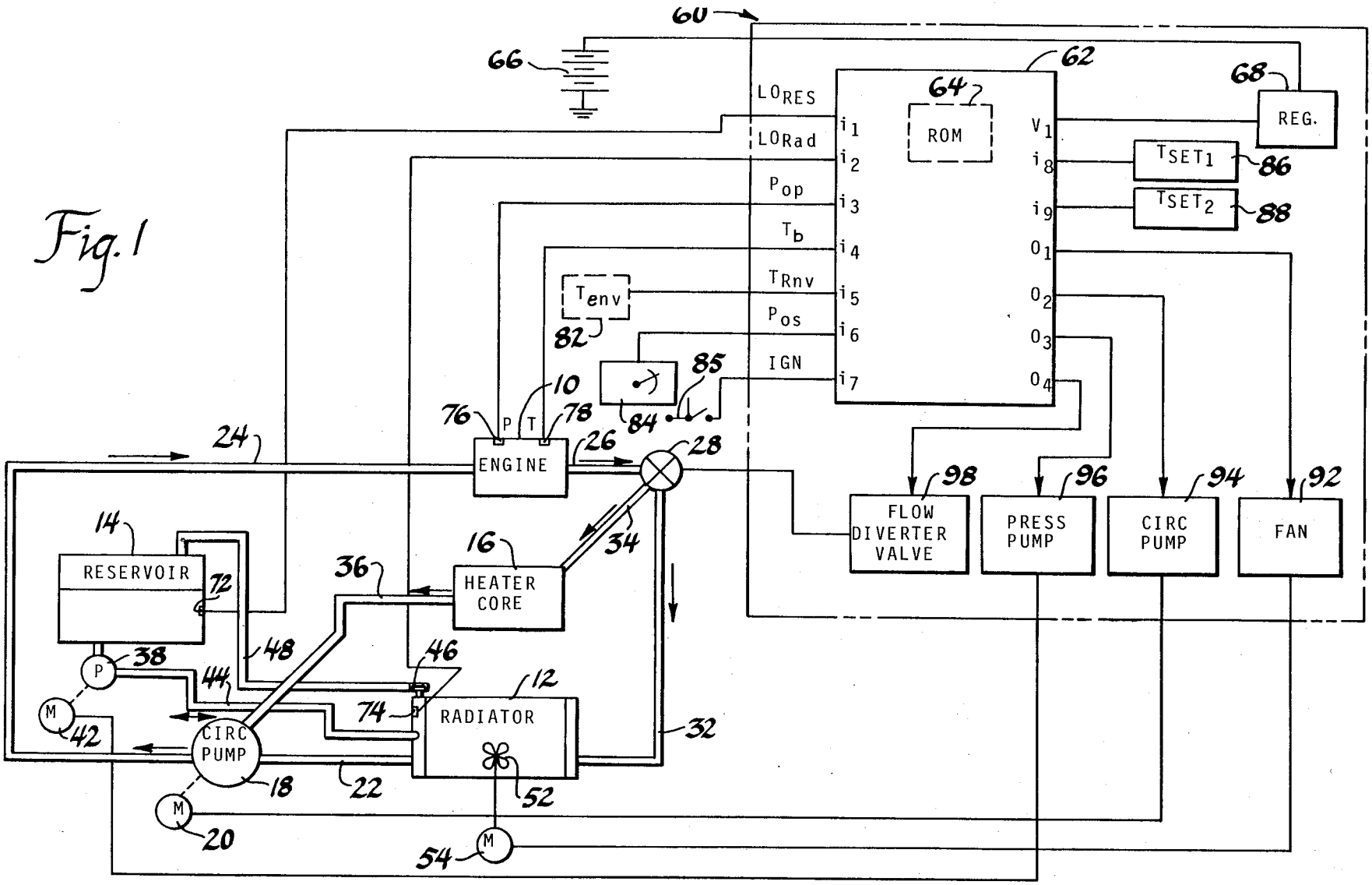
FIG. 1 is a schematic diagram of the cooling system of this invention.

Referring now to the drawings, there is shown an illustrative embodiment of the invention in an engine cooling system especially adapted for a passenger car with a passenger compartment heater. It will be appreciated, as the description proceeds, that the invention is useful in other automotive vehicle applications and also with non-automotive internal combustion engine applications. Further, the invention may be utilized in a wide variety of embodiments.

In order to achieve engine cooling with high energy efficiency and high engine operating temperature, the cooling system of this invention operates with liquid coolant in a state of nucleate boiling. The objective of the system is to continuously operate in the nucleate boiling range in the high heat flux regions of the engine, typically in the engine head, and with an increased bulk average coolant temperature without adversely affecting the metal temperatures. Heat transfer by nucleate boiling is much more power efficient than the conventional convective heat transfer. In convective heat transfer, the metal temperature must be kept below the boiling point of the liquid in order to prevent boiling. As a practical mater, an engine does not heat uniformly throughout and has hot spots, usually in the head, which run at substantially higher temperatures than other regions in the engine. It is necessary to control the hottest spot by establishing a flow rate for the liquid coolant which will maintain a safe metal temperature at the hottest spot. It is known, of course, that the heat transfer in the convection mode is increased with the flow rate of the liquid coolant. In a conventional engine cooling system, the circulation pump for the liquid coolant is driven by the engine and accordingly the flow rate increases with engine speed, not necessarily with increased load on the engine and increased need for radiator heat transfer. If the engine heat rejection increases to a point where there is insufficient flow rate and heat capacity, the metal temperature at the hot spot will exceed the boiling point of the liquid coolant and blanket boiling will occur. In blanket boiling, the vapor bubbles generated at the metal surface become large and the liquid coolant is intermittently prevented from reaching the metal and the metal temperature is further increased. This may lead to engine detonation or knocking or, in severe overheating it will result in cracking of the combustion enclosure.

In the engine cooling system of this invention which is continuously operated in the nucleate boiling range, the metal temperature is held at a temperature level above the coolant bulk temperature while maintaining a safe metal temperature at the hot spot in the engine. In nucleate boiling, small bubbles are formed at the metal-liquid interface and are replaced by liquid with a pumping action that scrubs the metal surface. The vapor bubbles are absorbed by the cooler liquid coolant at a distance from the metal where the temperature is less than the saturation temperature of the liquid, i.e. its boiling point. In nucleate boiling, the metal temperature is controlled by the saturation temperature and does not vary significantly with coolant flow rate or bulk coolant temperature, as it does in convection cooling. In nucleate boiling, the fluid heat capacity rate is greatly enhanced by the heat of vaporization of the liquid coolant which is taken up in the formation of the small bubbles. In an equalibrium condition with the coolant in a state of nucleate boiling, the metal is controlled by the boiling point of the liquid.

Figure 2:
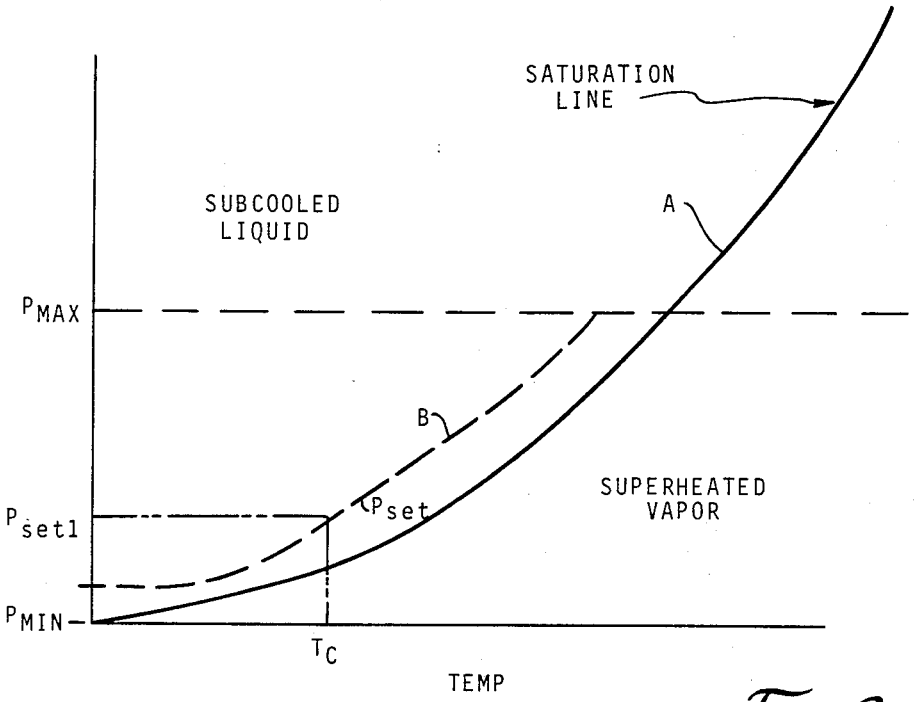
FIGS. 2, 3A, 3B AND 4 are graphical representations to aid in explanation of the invention.

In operation of the cooling system of this invention, the liquid coolant is pressurized to an operating pressure which varies in accordance with coolant temperature such that the coolant is continuously maintained in a nucleate boiling condition. FIG. 2 is a phase diagram for a typical liquid coolant such, for example, as a mixture of ethylene glycol and water. In this graph, curve A represents the pressure as a function of temperature at which the liquid coolant becomes a vapor. Curve A is the saturation line for the liquid. The saturation temperature, or boiling point of the liquid, is given for lowest operating pressure $P_{min}$ possibly below atmospheric, which is chosen by the designer. At temperatures to the left of the saturation line, the fluid is in a subcooled liquid state and at temperatures to the right of the saturation line the fluid is a superheated vapor. The curve B, shown in dashed line, represents the set pressure $P_{set}$ which is a value of pressure for a given temperature that is greater than the saturation pressure to maintain a bulk liquid phase at the given temperature. The maximum allowable cooling system pressure set by durability constraints is represented by the horizontal line at the pressure value, $P_{max}$. The value of $P_{set}$ relative to the saturation pressure is established experimentally for a given engine. Its value is selected as to maintain nucleate boiling throughout the critical region or hot spot in the engine. Under engine operating conditions in which the engine heat rejection is at a moderate rate, the cooling system of this invention maintains the engine operating temperature substantially constant. As shown in FIG. 2, a set or control temperature $T_c$ is established which corresponds to the desired bulk temperature of the coolant measured at a selected location in the engine. The control temperature $T_c$ corresponds to the set pressure $P_{set\ 1}$ which maintains the liquid coolant in the nucleate boiling condition which was determined to result in desired engine metal operating temperatures as indicated in FIG. 2. For the purpose of operating the engine at the control temperature over a relatively wide range of heat rejection rates, the flow rate of the coolant is established so that the heat transfer by the radiator to the atmosphere matches the engine heat rejection at a given engine operating condition, as will be discussed below.

The cooling system of this invention is adapted to operate in three distinct modes depending upon the rate of heat rejection from the engine. In the first mode, which occurs over a relatively narrow range of low ambient temperatures or low rates of heat rejection, the other combined heat rejection levels are adequate without circulation through the radiator to keep the bulk coolant temperature less than the control temperature. In the second mode, which occurs over a relatively wide range of intermediate rates of heat rejection, the bulk coolant temperature is maintained at a substantially constant control temperature and set pressure to produce nucleate boiling by adjusting circulation through the radiator. In the third mode, which occurs over a relatively narrow range of high engine heat rejection rates, the control temperature is increased with increasing heat rejection and the coolant is maintained in a nucleate boiling condition. These different modes of operation will be described further with reference to the graphical representation of FIGS. 3A and 3B.

Figure 3A:
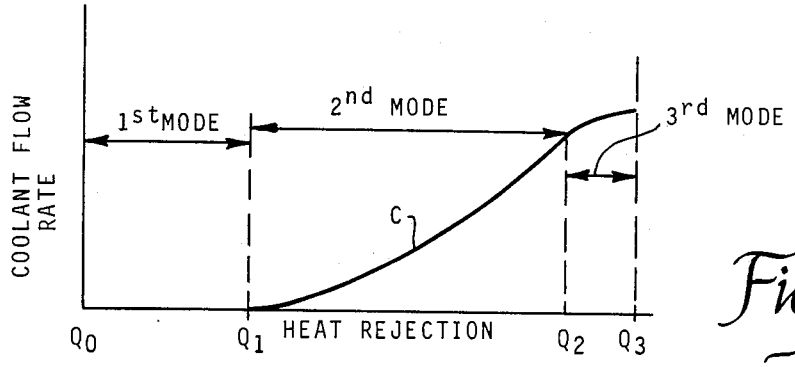
Figure 3B:
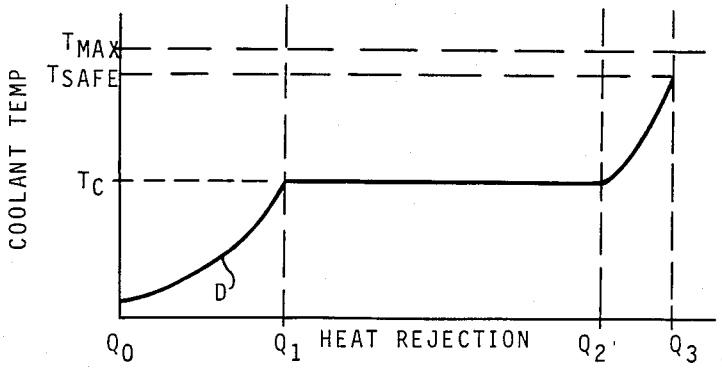

FIG. 3A shows the circulating flow rate of the liquid coolant as a function of engine heat rejection rate. The first mode of operation occurs in the low heat rejection range from $Q_0$ to $Q_1$. With the vehicle engine running under light load, as for example at road speed on a flat roadway, and at low ambient temperature, the heat rejection from the engine is low enough so that no coolant flow through the radiator is required. In this case, the convection losses directly to the atmosphere are equal to the engine heat rejection. ( This may include convection losses from a passenger compartment heater which receives circulating coolant even though there is no coolant flow through the radiator.) As shown in FIG. 3B wherein coolant temperature is plotted as a function of engine heat rejection, the temperature during the first mode of operation is less than the control temperature $T_c$. Over this low range of heat rejection rates, the coolant temperature increases with heat rejection rate from ambient temperature to the control temperature.

The second mode of cooling system operation occurs over a wide intermediate range of heat rejection rates from a low of Q·to a high of $Q_2$. As shown in FIG. 3A, the circulating flow rate of the coolant increases with increasing heat rejection. The coolant flow rate is controlled so that the radiator performance matches the engine heat rejection rate to coolant at the control temperature of the coolant. As shown in FIG. 3B, the coolant temperature remains substantially constant at the value $T_c$ throughout this intermediate range of heat rejection rate. In the second mode of operation, the coolant pressure is controlled at a substantially constant value of $P_{set}$ so that nucleate boiling is continuously maintained, as described with reference to FIG. 2.

In the third mode of operation, which occurs with the engine under very heavy load and high heat rejection rates, the coolant flow rate is not adequate to maintain the coolant at the control temperature $T_C$. This may be by reason of design in which the coolant flow rate is limited to a certain value to prevent oversizing the circulating pump and/or undue wear on the radiator and other cooling system components. As shown in FIG. 3A, the coolant flow rate levels off in the high range of heat rejection rates. As shown in FIG. 3B, the coolant temperature at the heat rejection rate $Q_2$ is at the control temperature $T_c$ whereas at the maximum heat rejection rate $Q_3$ for the engine design, the coolant temperture is at an upper limit for "bogey" temperature $T_{safe}$ which is considered to be the maximum safe operating temperature for the engine for short term or transient operation. This bogey temperature is less, by a selected margin of safety, than the saturation temperature $T_{max}$ of the boolant at the maximum coolant pressure $P_{max}$ allowable for the engine metal temperature limitations or cooling system design. Thus, throughout this high heat rejection range from $Q_2$ to $Q_3$ the coolant pressure is adjusted according to the saturation temperature so as to maintain nucleate boiling of the coolant. It will be understood that the cooling system, for a given engine and range of operating conditions, could alternatively be designed so as to provide operation in the second mode, i.e. at substantially constant control temperature, throughout the range of heat rejection rates form $Q_1$ to $Q_3$ with the radiator performance, at the control temperature $T_c$, matching the heat rejection throughout this range.

Figure 4:
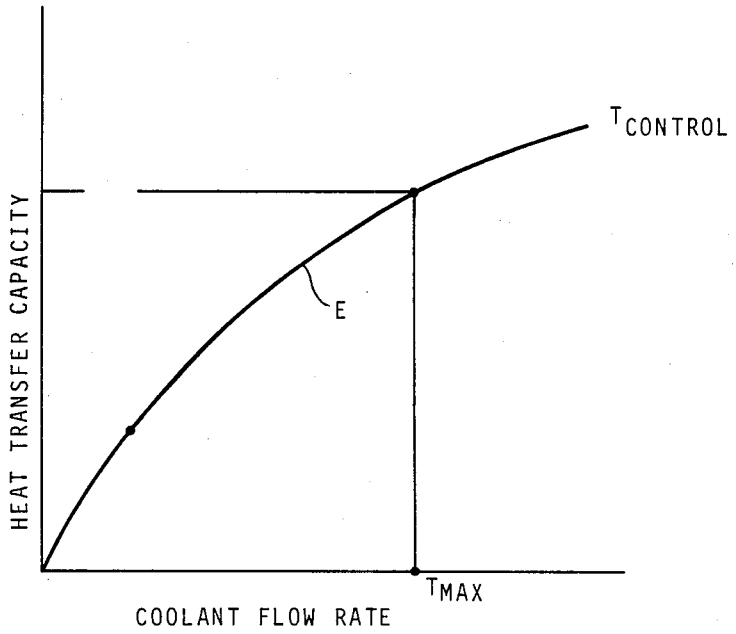

For a given engine, it is necessary to determine the desired bulk coolant temperature and flow rate which are to be maintained by the cooling system operating in a nucleate boiling condition. For this purpose, an operating pressure which results in a safe metal temperature is determined for the given engine, taking into account hot sports. The desired bulk coolant temperature is established at a temperature equal to or somewhat lower than the safe metal temperature. The desired bulk coolant temperature is taken as the control temperature $T_c$. As discussed with reference to FIG. 2, the value of pressure for a given control temperature to obtain nucleate boiling is determiend from the known relationship and, as discussed with reference to FIGS. 3A and 3B, the flow rate is adjusted to maintain the control temperature $T_c$. To operate the cooling system in the second mode discussed above, i.e. at a constant control temperature over a range of engine heat rejection rates, it is necssary to match the radiator performance to the engine heat rejection rate. The relationship for this purpose is depicted graphically in FIG. 4. In this figure, the heat transfer capacity of the radiator is plotted as a function of coolant flow rate for a given set of air flow rate and air and coolant inlet temperatures. For a given radiator, the bulk coolant temperature is maintained at the selected control temperature $T_c$ by adjusting the flow rate. The maximum flow rate $F_{max}$ of the system is determined by the flow required to transfer the maximum heat rejection by the engine and maintain the coolant bulk temperature at the control temperature $T_c$. If the coolant bulk temperature as measured at a selected location in the engine is greater than the control temperature the coolant flow is increased and if it is less than the control temperature it is decreased. In the graphical representation of FIG. 4, the curve E represents the radiator capacity for a selected control temperature for a given radiator and a given combination of air flow rate and air and coolant inlet temperature. The curve E represents coolant flow rate to maintain a selected control temperature such as 210 degrees F.; there is a different curve for each different value of control temperature.

The illustrative embodiment of this invention is shown diagrammatically in FIG. 1 in a cooling system for an automotive vehicle engine 10. In this embodiment, the system includes heater for the passenger compartment of the automotive vehicle as will be described subsequently. The system comprises, in general, the engine 10 which is provided in a conventional manner with coolant passages through the head and the block. It also comprises a radiator 12, a coolant reservoir 14 and a heater core 16 for the passenger compartment heater. A coolant circulating system is provided and includes a circulating pump 18 which is driven by a variable speed motor 20. One inlet of the circulating pump 18 is connected by a conduit 22 to the outlet of the radiator 12. The outlet of the circulating pump is connected through a conduit 24 with the inlet to the coolant passages in the engine 10. The outlet of the coolant passages of the engine 10 is connected through a conduit 26 to a flow diverter valve 28 which has one outlet connected through a conduit 32 to the inlet of the radiator 12. The diverter valve 28 has another outlet connected through a conduit 34 the heater core is connected through a conduit 36 to another inlet of the circulating pump 18. A coolant pressurizing system is provided and includes a pressure pump 38 preferably a positive displacement pump. The pressure pump 38 is driven by a servo motor 42. The pressure pump 38 is adapted to pump liquid coolant between the reservoir 14 and the radiator 12 in either direction and for this purpose has one inlet/outlet port connected directly with the reservoir and the other inlet/outlet portion connected through conduit 44 with the inlet/outlet port of the radiator 12. The fill tube of the radiator 12 is closed with a cap which is provided with a pressure relief valve 46. The pressure relief valve limits the presure in the system to a predetermined maximum value and is connected through a conduit 48 with the reservoir 14. The radiator 12 is also provided with a fan 52 which is driven by a variable speed electric motor 54.

The engine cooling system includes an electronic control system which comprises an electronic control module 60. The control module includes a microcomputer 62 having a read-only memory 64. The read-only memory stores the control program for the microcomputer; it also stores certain data required for cooling system operation such as a look-up table for the coolant operating pressure $P_{set}$ as a function of coolant bulk temperature for nucleate boiling. The vehicle battery 66 supplies electrical power to the electronic control module 60. The negative terminal battery is connected to ground and the positive terminal is connected through a voltage regulator 68 to the voltage supply port $V_1$. Variable input data required for control of the cooling system is supplied to the microcomputer as follows. A low coolant level problem 72 in the reservoir 14 supplies an input signal to input port $I_1$ of the microcomputer 62. Similarly, a low coolant level probe 74 in the radiator supplies a signal to the input port $1_2$. A pressure sensor 76 in the engine coolant passages supplies a pressure signal corresponding to coolant operating presure $P_{op}$ to the input port $1_3$. A temperature sensor 78 in the coolant passage of the engine detects coolant bulk temperature $T_b$ and supplies a signal to input port $i_4$. For the purpose of passenger compartment heat control, a temperature sensor 82 senses the compartment environmental temperature $T_{env}$ and supplies a signal to input port $i_5$. Also, for heater control purposes, a position sensor 84 for the heater temperature control lever supplies an input signal to input port $i_6$. A conductor to the engine ignition switch 85 supplies an input signal to input port $i_7$ to signify when the ignition is on. A signal generator 86 develops a signal $T_{set1}$ which represents a bulk coolant temperature shown through tests to maintain a safe engine metal temperature $T_{safe}$ during normal vehicle operation while the cooling system operates in the nucleate boiling regime. The signal from the generator 86 is supplied to the input port $i_8$. A signal generator 88 develops a signal $T_{set\,2}$ which represents a bulk coolant temperature higher than $T_{set\,1}$ which will maintain a safe metal temperature but which is used only when a maximum heat-up rate is required for the vehicle heater. This signal from generator 88 is supplied to input port $i_9$.

The microcomputer 62 operates under program control to develop output signals for control of the various components of the cooling system. A fan speed signal is developed at output port $o_1$ which is supplied to a fan speed control circuit 92 which, in turn, is connected with the fan motor 54. The circulating pump speed signal is developed at output pump $o_2$ and is applied to the circulating pump control circuit 94 which in turn is connected with the circulating pump motor 20. A pressure pump servo signal is developed at out put port $o_3$ and applied to the pressure pump servo circuit 96 which, in turn, is connected with the servo motor 42. A diverter valve position signal is developed at output port $o_4$ and controls the position of the diverter valve 28.

The cooling system is controlled by the electronic control module 60. The computer program for the microcomputer 62 is represented by the flow charts of FIGS. 5 through 9. The operation of the cooling system under program control will now be described with reference to the flow charts of FIGS. 5 through 9.

Figure 5:
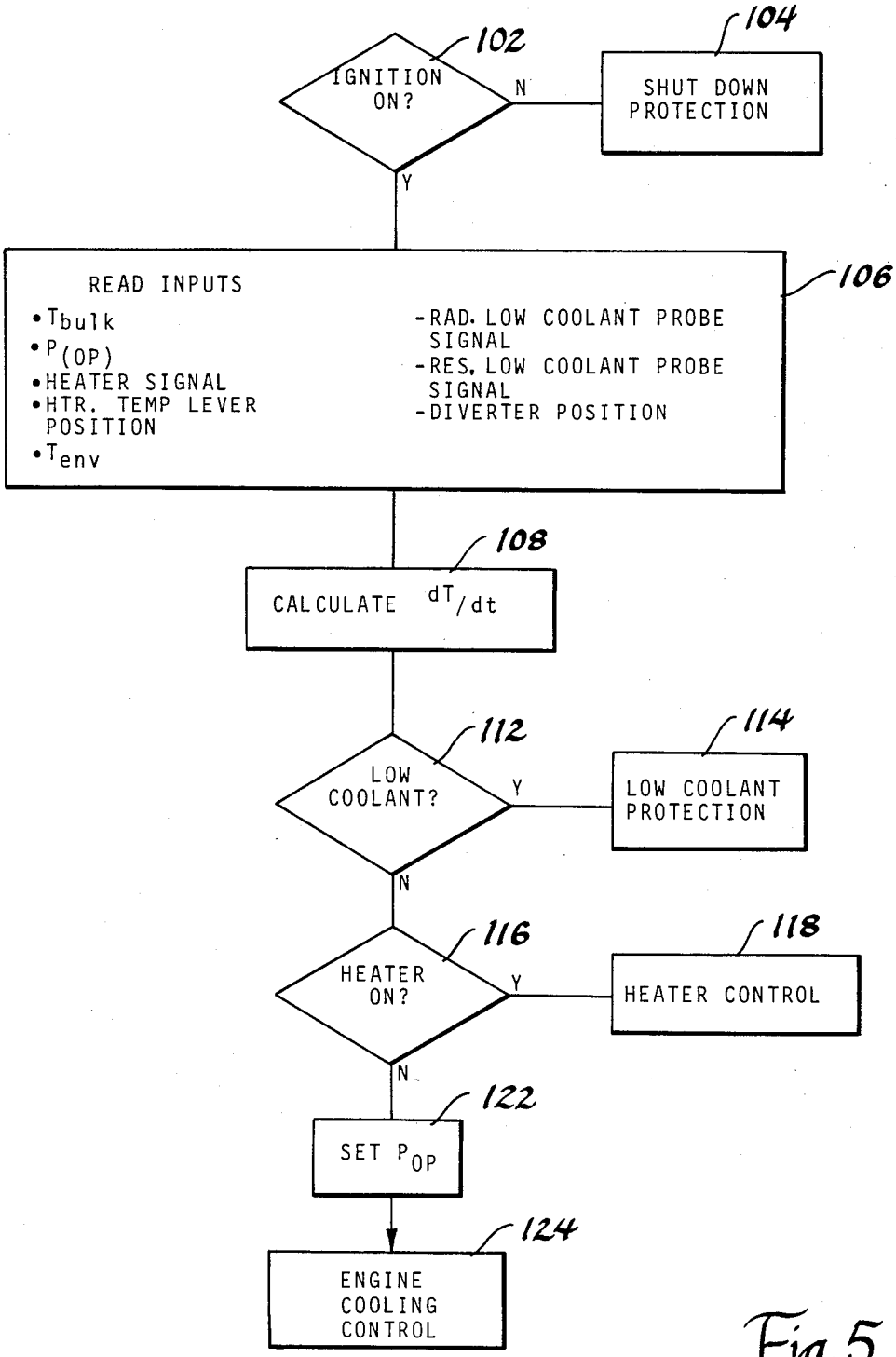
FIG. 5 is a flow chart representing the main program of the microcomputer of the control system.

The main program is represented in the flow chart of FIG. 5. This program will be described first and then the subroutines referred to therein will be described. The cooling system is operable during engine operation and it is also operable after the engine is shut-off to protect against after-boil. The microcomputer, under program control makes a periodic check by the test block 102 to see whether the ignition switch is on. If it is not on but was on during the previous check, the program branches to the shut-down protection routine of block 104. If the ignition is on, the program advances to the block 106 and the system thereby reads the inputs from the various sensors and probes as indicated. Then, the program advances to block 108 which calculates the rate of change of bulk temperature with respect to time. Following this calculation, test block 112 checks both coolant probes 72 and 74 to see whether either the radiator or reservoir coolant is low. If either is low, the program branches to the low coolant protection subroutine 114. If neither coolant level is low, the program advances to the test block 116 which determines whether the position detector indicates that the heater temperature control lever is in a position to turn the heater on. If is is, the program branches to the heater control subroutine 118. If it is not, the program advances to the block 122 which actuates the pressure pump 38 to adjust the operating pressure $P_{op}$ of the fluid coolant to that value of $P_{set}$ corresponding to the control temperature which will result in nucleate boiling. With the operating pressure set, the program advances to the engine cooling control subroutine 124. The engine cooling control subroutine 124 controls the engine cooling system continuously when the engine is running. During control of engine cooling, the program continuously cycles through the main program of FIG. 5, as just described, to update the input data and to determine whether any of the subroutines should be executed.

Figure 6:
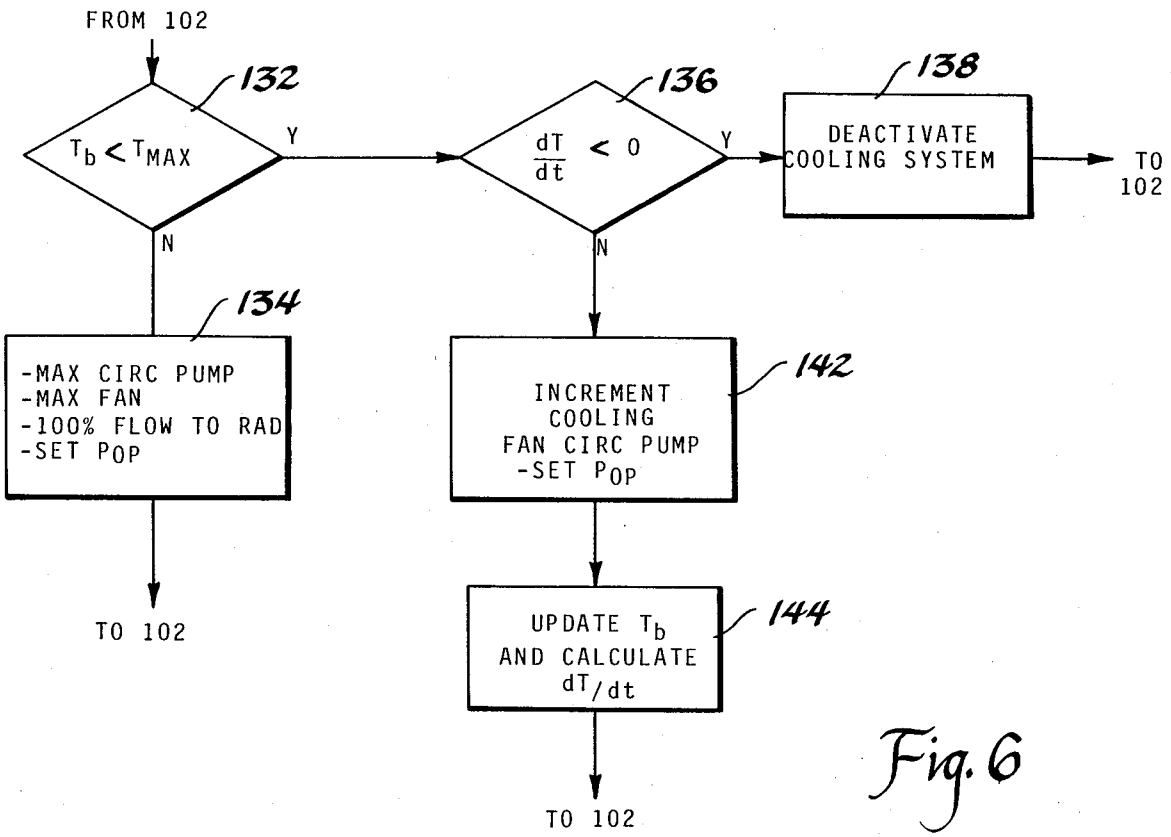
FIG. 6 is a flow chart representing the engine shut down protection subroutine.

The engine shut-down protection subroutine 104 will now be described. If the test block 102 determines that the ignition is not turned on (but was on during previous check,) the program branches to the subroutine 104 which is represented in FIG. 6. The test block 132 determines whether the bulk coolant temperature $T_b$ is less than the maximum allowable temperature $T_{max}$. If the bulk coolant temperature is greater than $T_{max}$ as determined by test block 132, the program advances to block 134 which causes the system to execute maximum corrective action to prevent after-boil in the engine. This corrective action, as indicated, may include setting the circulating pump and the fan to maximum speed and to set the diverter valve so that the entire coolant flow is through the radiator. It may also include setting the coolant operating pressure $P_{op}$ at the set valve $P_{set}$ to provide for nucleate boiling. From block 134, the program returns to test block 102. If, in the engine shutdown subroutine, the test block 132 determined that the coolant bulk temperature $T_b$ is less than the specified value, the program would proceed to the test block 136 which determines whether the rate of change of coolant temperature with respect to time is less than zero, i.e., whether the temperature is decreasing. If it is, the cooling system is deactivated by the block 138 and the program returns to the test block 102. If, on the other hand, the coolant temperature is not decreasing, as determined by test block 136, even though the coolant bulk temperature is less than the specified value, there is need for increased cooling. Accordingly, the program advances to block 142 which increases the cooling, as by turning on the circulating pump and the radiator fan and sets $P_{op}$. Then, the program advances to block 144 which updates the reading of the bulk coolant temperature $T_b$ and calculates the time rate of change of bulk coolant temperature dT/dt. The program then loops back to block 102.

Figure 7:
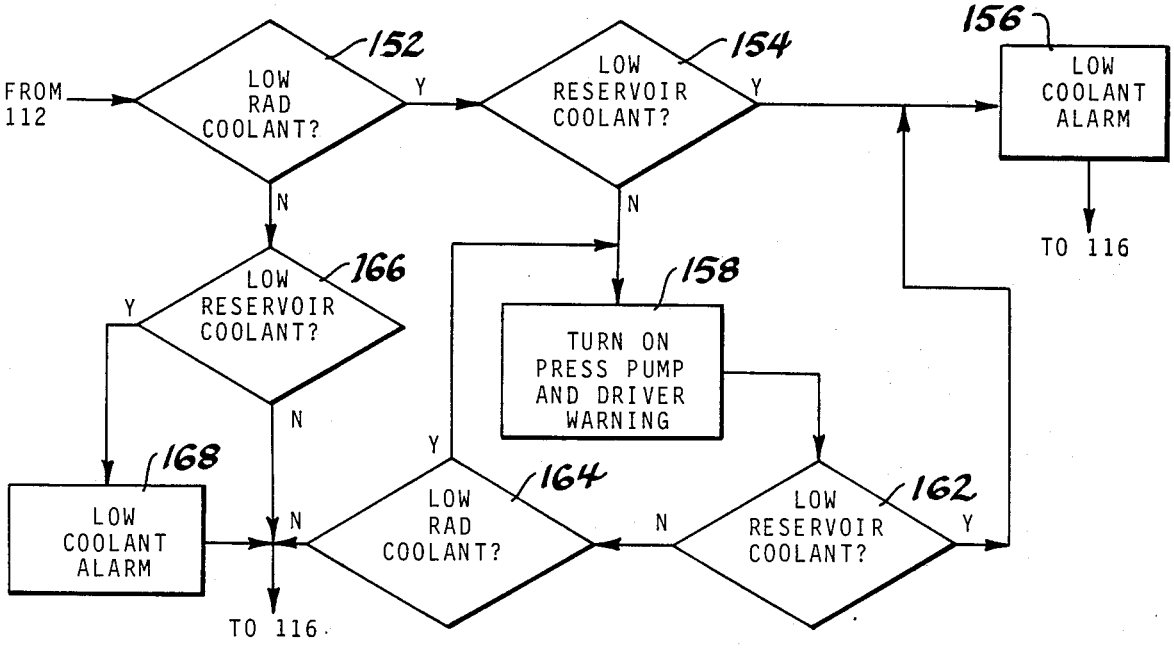
FIG. 7 is a flow chart representing the low coolant protection subroutine.

The low coolant protection subroutine of FIG. 7 will now be described. In the program of FIG. 5, the test block 112 determined whether the coolant level was low in either the reservoir or in the radiator. If it is low in either, the program branches to the subroutine 114 of FIG. 7. In this subroutine, the test block 152 determines whether the radiator coolant is low. If it is, the program advances to test block 154 which determines whether the coolant in the reservoir is low also. If it is, the program advances to the block 156 which turns on a low coolant alarm which may be a visual or audible signal for the driver. If the test block 154 determines that the coolant level in the reservoir is not low, the program proceeds to block 158 which turns on the pressure pump and a driver warning signal indicating that there may be a coolant leak in the system. The pressure pump operates to pump coolant from the reservoir to the radiator. Test block 162 determines whether the coolant level in the reservoir is low. If it is, the program advances to block 156 which turns on the low coolant alarm. If it is not, the program advances to test block 164 to determine whether the fluid level in the radiator is low. If the coolant level in the radiator is low, the program loops back to block 158. If it is not low, the program proceeds to test block 116 shown in FIG. 5.

If it is determined at test block 152 of the low coolant protection subroutine 114 that the radiator coolant level is not low, the program advances to the test block 166. This block determines whether the coolant level in the reservoir is low. If it is not, the program advances to test block 116. If test block 166 determines that the coolant level in the reservoir is low, the program proceeds to block 168 which turns on the low coolant alarm and the program advances to test block 116.

Figure 8:
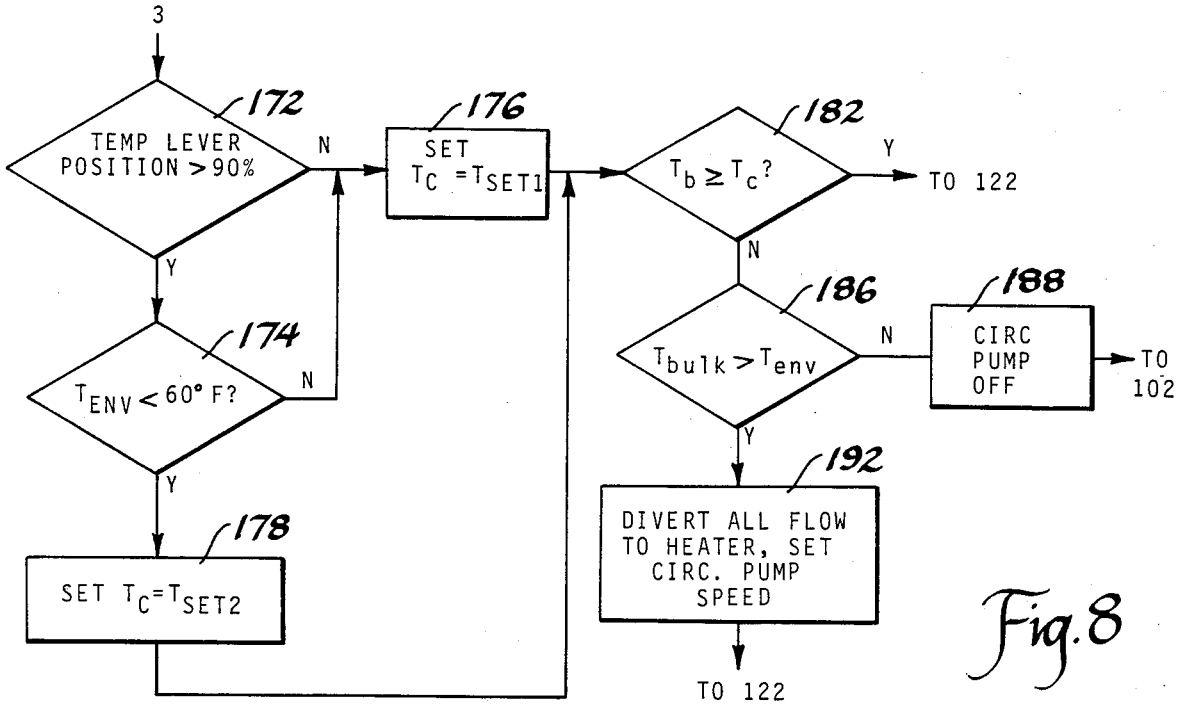
FIG. 8 is a flow chart representing the heater control subroutine.
Figure 9:
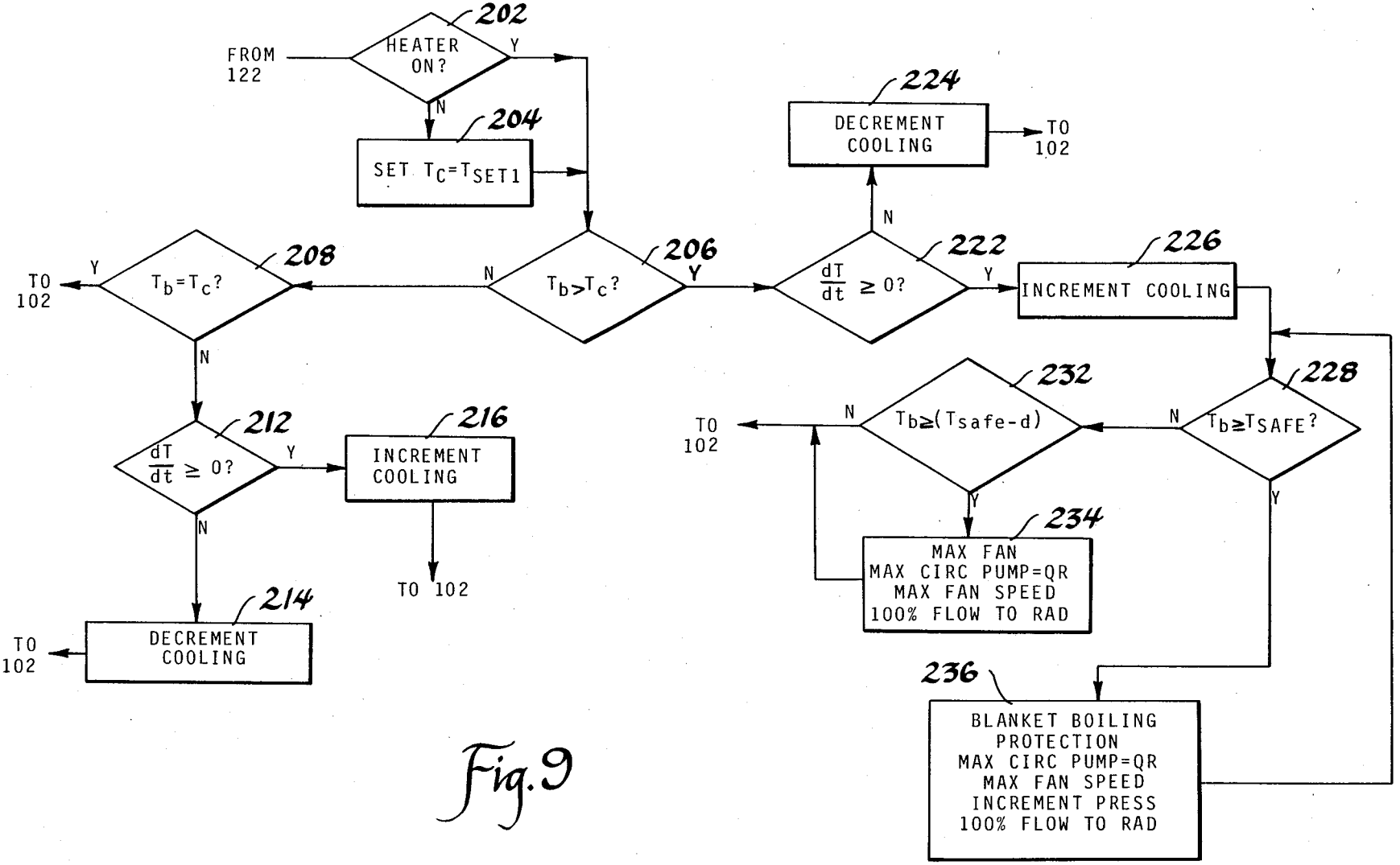
FIG. 9 is a flow chart representing the engine cooling control subroutine.

The heater control subroutine 118 will now be described with reference to FIG. 8. If test block 116 determines that the passenger compartment heater is turned on and is thus calling for heat, the program advances to the heater control subroutine 118. In this subroutine, the test block 172 determines whether the temperature lever position is set for high temperature such as that represented by a lever position greater than ninety percent of its maximum position. If it is, the program advances to test block 174 which determines whether the temperature in the passenger compartment, i.e. the environmental temperature, $T_{env}$ is less than a moderately comfortable temperature, for example, sixty degrees F. If it is not, the program advances to block 176 which sets the control temperature $T_c$ equal to $T_{set}$ 1 for normal heater operation. Then the program advances to block 182. If the test block 174 determines that the environmental temperature $T_{env}$ is less than sixty degrees F, the program advances to block 178 which sets $T_c$ equal to $T_{set2}$ for accelerated heating of the passenger compartment. Then, the program advances to the test block 182. Test block 182 determines whether the bulk coolant temperature $T_b$ is equal to or greater than the control temperature $T_c$. If it is, the program proceeds from block 184 to block 122 (see FIG. 5) and the engine cooling control subroutine 124. If the test block 182 determines that the coolant bulk temperature is not equal to or greater than the control temperature, the program advances to test block 186 which determines whether the bulk temperature is greater than the environmental temperature $T_{env}$. If it is not, there is no use in circulating the low temperature coolant through the heater core and block 188 turns the circulating pump off. Then, the program loops back to test block 102. If, on the other hand, the bulk temperature is greater than the environmental temperature, as determined by test block 186, the program advances to block 192. This block diverts all of the flow of the coolant to the heater core and sets the circulating pump speed to a suitable speed for heater circulation. Then, the program advances to block 122 which is shown in FIG. 5.

As discussed above, block 122 sets the coolant operating pressure $P_{op}$ at the value required for cooling system operation. As previously described, the operating pressure $P_{op}$ is maintained at a value approximately equal to or somewhat greater than the saturation pressure for the value of the bulk coolant temperature $T_b$ so as to maintain nucleate boiling. The program advances from block 122 to the cooling system control subroutine 124 which will now be described with reference to FIG. 9. In this subroutine, test block 202 determines whether the heater is turned on and is thus calling for heat. If it is not, the block 204 sets the control temperature $T_c$ equal to $T_{set\ 1}$ as defined above. Then, the program advances to the test block 206. If test block 202 determines that the heater is on, the program advances to test block 206 which determines whether the bulk coolant temperature $T_b$ is greater than the control temperature $T_c$. If it is not, the test block 208 determines whether the bulk temperature $T_b$ is equal to the control temperature $T_c$. If it is, the rate of cooling by the cooling system is satisfactory and the program loops back to test block 102. If the bulk temperature $T_b$ is not greater than and not equal to the control temperature $T_c$ the program advances from test block 208 to test block 212 which determines whether the time rate of change of the bulk temperature is equal to or greater than zero, i.e. whether it is increasing. If it is not, block 214 decreases the rate of cooling by decreasing the speed of the circulating pump or the speed of the radiator fan or both. Then, the program loops back to test block 102. If the test block 212 determines that the temperature of the coolant is increasing, the block 216 increases the cooling rate of the cooling system by increasing the circulating pump speed or the fan speed or both. Then, the program loops back to test block 102. The adjustment of the bulk temperature $T_b$ by decreasing or increasing the rate of cooling, as referred to above, by control blocks 214 and 216 is provided by a known type of feedback control system. The degree to which the cooling system capacity is decremented or incremented for this purpose is determined with due regard to the time rate of change of the bulk temperature $T_b$ and the difference between $T_b$ and the control temperature $T_c$.

When the bulk coolant temperature is $T_b$ and is greater than the control temperature $T_c$, as determined by test block 206, the program advances therefrom to the test block 222. This test block determines whether the time rate of change of the bulk temperature is greater than or equal to zero, i.e. whether it is increasing or is not changing. If it is not increasing and it is not changing, block 224 decreases the rate of cooling by decreasing the circulating pump speed or the fan speed or both. Then, the program loops back to test block 102. If, on the other hand, it is determined by test block 222 that the bulk coolant temperature $T_b$ is increasing, the block 226 is operative to increase the rate of cooling by increasing the speed of the circulating pump or the fan or both. The control blocks 224 and 226 operate on the principle of feedback control as mentioned above with reference to control blocks 214 and 216.

From control block 226, the program advances to the test block 228 which determines whether the bulk coolant temperature $T_b$ is equal to or greater than the maximum allowable coolant temperature, $T_{safe'}$ which will assure safe metal temperature. If it is not equal to or greater than $T_{safe'}$ the program advances to test block 232 which determines whether the bulk coolant temperate is equal to or greater than $T_{safe\ -d'}$ where d is an increment of temperature to provide a margin of safety for the metal temperature. If it is not, the program loops back to test block 102. If it is, block 234 increases the cooling by, for example, diverting all coolant flow to the radiator and setting the circulating pump and the fan motor for maximum speed. Then the program loops back to test block 20. If on the other hand, the test block 228 determines that the bulk coolant temperature $T_b$ is equal to or greater than the temperature $T_{safe'}$ the engine must be protected against blanket boiling. This condition arises when the engine heat rejection rate is beyond the cooling system capacity as established by existing parameters. In this condition, the heat transfer capacity is insufficient to maintain a constant control temperature and consequently it is necessary to increase the coolant pressure in order to stop blanket boiling and re-establish nucleate boiling. For this purpose, the program advances from test block 228 to block 236 which diverts the entire coolant flow to the radiator, sets the circulating pump speed and the fan speed to their maximum values and also turns on the pressure pump to recharge the system with coolant from the reservoir and increase the coolant pressure. Then the program loops back to the test block 228; if the coolant temperature is still equal to or greater than $T_{safe'}$, the block 236 operates the pressure pump to increase the coolant pressure by an additional increment. Then, the program loops back to test block 228 and this loop is repeated until the temperature of the coolant is decreased below the temperature $T_{safe}$. The program then advances to test block 232 and thence directly to test block 102 or indirectly through block 234.

Although the description of this invention has been given with reference to a particular embodiment, it is not to be construed in a limiting sense. Many variations and modifications will now occur to those skilled in the art. For a definition of the invention reference is made to the appended claims.

What is claimed is:

1. The method of operating an engine cooling system of the type comprising a heat exchanger, means for circulating a liquid coolant through coolant passages in the engine and through the heat exchanger, and means for adjusting the cooling effect of said heat exchanger on said fluid, said method comprising the steps of:

adjusting the heat transfer capacity of said heat exchanger to maintain said coolant at a control temperature at a selected location in said cooling passages, and adjusting the static pressure of said coolant to a value at which it will have a saturation temperature in a predetermined relation with the control temperature such that nucleate boiling will occur at the interface of the engine metal and coolant to maintain a safe engine metal temperature.

2. The invention as defined in claim 1 including the steps of:

determining the difference between the coolant temperature and the control temperature and the time rate of change of the coolant temperature, and adjusting said heat transfer capacity by changing the flow rate of said coolant in accordance with said difference and said time rate of change so that the coolant temperature is adjusted toward the control temperature.

3. The invention as defined in claim 1 including the steps of:

circulating the liquid coolant through said heat exchanger after the engine has been turned off if the bulk coolant temperature is greater than a predetermined temperature and if the coolant temperature is increasing.

4. The method of operating an engine cooling system of an automotive vehicle having a passenger compartment, said cooling system being of the type comprising a radiator, a passenger compartment heater, a circulating pump for circulating a liquid coolant through the coolant passages in the engine and through the radiator and heater, and a heater control including a temperature selector for said heater, said method comprising the steps of:

measuring the bulk coolant temperature at a selected location in said coolant passages, operating said circulating pump at variable speed to produce a flow rate through said heat exchanger to maintain said bulk coolant temperature at a predetermined value, adjusting the static pressure of said coolant to a value at which it will have a saturation temperature in predetermined relation with said predetermined temperature such that nucleate boiling will occur at the interface of the engine metal and coolant at said location, diverting at least some of said coolant flow to said heater when the bulk coolant temperature is less than said predetermined temperature and greater than the temperature in said passenger compartment, and diverting at least some of said coolant flow to said radiator when the bulk coolant temperature is greater than said predetermined temperature.

5. The invention as defined in claim 4 wherein said cooling system includes a coolant reservoir and means for sensing coolant level in said radiator, said method including the steps of:

pumping coolant from the reservoir to the radiator if the radiator coolant level is low.

6. In an engine cooling system of the type comprising a heat exchanger, a circulating pump for circulating a liquid coolant through coolant passages in the engine and through the heat exchanger, the improvement comprising:

means for adjusting the heat transfer capacity of said heat exchanger to maintain said coolant at a predetermined control temperature at a selected location in said passages, means for pressurizing the cooling system so that the saturation temperature of the coolant is in predetermined relation with said control temperature such that nucleate boiling will occur at the interface of the engine metal and said coolant.

7. The invention as defined in claim 6 wherein:

said system includes a coolant reservoir, said means for pressurizing comprises a pump connected between said radiator and said reservoir and adapted to pump coolant from either one to the other, and a pressure relief valve on said radiator for limiting the maximum pressure in said system.

8. The invention as defined in claim 7 wherein:

said system includes a heater connected in parallel with said radiator between the outlet of said engine cooling passages and said circulating pump, and a flow diverter valve having an inlet connectd with the outlet from said engine, a first outlet connected to the heater and a second outlet connected to the radiator.

* * * * *